US005832541A

United States Patent [19]

Rock

[11] Patent Number: 5,832,541

[45] Date of Patent: Nov. 10, 1998

[54] FOOTBALL HELMET INCORPORATING A TURF GUARD

[76] Inventor: Kyle Rock, 69, Soper St., Morrisonville, N.Y. 12962

[21] Appl. No.: 873,176

[22] Filed: Jun. 11, 1997

[51] Int. Cl.[6] ..... A42B 3/18

[52] U.S. Cl. ..... 2/424; 2/425

[58] Field of Search ..... 2/410, 411, 412, 2/422, 424, 425, 9

[56] References Cited

U.S. PATENT DOCUMENTS

| | | | |
|---|---|---|---|
| 4,173,795 | 11/1979 | Lundin et al. . | |
| 4,233,687 | 11/1980 | Lancellotti | 2/9 |
| 4,271,537 | 6/1981 | Bowlus et al. | 2/424 |
| 4,774,729 | 10/1988 | Coates et al. | 2/424 |
| 4,947,490 | 8/1990 | Hayden | 2/424 |
| 5,123,116 | 6/1992 | Roth . | |
| 5,216,758 | 6/1993 | Rabquer | 2/424 |
| 5,479,658 | 1/1996 | Harris . | |
| 5,502,843 | 4/1996 | Strickland | 2/424 |
| 5,553,330 | 9/1996 | Carveth . | |

*Primary Examiner*—Michael A. Neas

*Attorney, Agent, or Firm*—Birch, Stewart, Kolasch and Birch, LLP

[57] ABSTRACT

A turf guard is fixed to the top rod of the face mask of a football helmet and is shaped to prevent any foreign matter, such as grass or the like, from being lodged between the top rod and the lower edge of the helmet.

3 Claims, 3 Drawing Sheets

FOOTBALL HELMET INCORPORATING A TURF GUARD

BACKGROUND OF INVENTION a) Field of Invention

The present invention relates to a football helmet incorporating a turf guard. More particularly, the present invention is concerned with an improvement to a football helmet or the like, specifically in so far as the face mask, which prevents turf or dirt from being lodged between the top rod of the face mask and the helmet.

b) Description of the Prior Art

For many years, face masks have formed part of the football helmet, and this has resulted in avoiding many serious injuries. The standard face mask is traditionally manufactured from steel rods which are bent to shape, to constitute a protection for the face of the football player. The rods are welded together into a unit which includes a top rod that rests against the outer face of the helmet at the front edge thereof. Now, it is a well known fact that due to the nature of the game, contact between the players often throws them to the ground. Occasionally, the face of the player touches the turf to the extent that pieces of grass and/or dirt get stuck between the top rod and the helmet, especially when playing on natural grass when the ground is soft. These pieces of grass and/or dirt are often very annoying to the players and may even cause them to loose their concentration or their vision may even become impaired.

There is therefore a need to improve the football helmet so as to prevent undesirable material such as turf, grass, dirt and the like from penetrating into the void between the helmet and the top rod of the face mask.

A review of the prior art is of no help in trying to overcome the problems associated with the design of the present day football helmet and face mask combinations. For example, U.S. Pat. No. 4,173,795 issued Nov. 13, 1979 to Lundin et al discloses a resilient pad that is attached to the mask assembly of a racquetball or squash safety mask for improving comfort. U.S. Pat. No. 5,123,116 issued Jun. 23, 1992 to James M. Roth discloses an attachment for a wrestling blinder which is rolled over the front band of a headgear. U.S. Pat. No. 5,216,758 issued Jun. 8, 1993 to Rabquer describes a face mask attachment which covers the openings of the face mask except at the eye level, and which intends to reduce face mask grabbing. Portions of the face mask attachment are looped around portions of the face mask. U.S. Pat. No. 5,479,658 issued Jan. 2, 1996 to Daniel S. Harris discloses a sheet of rigid material covering a portion of the face mask and on which decorations can be applied. Finally, U.S. Pat. No. 5,553,330 issued Sep. 10, 1996 to William H. Carveth discloses a hockey helmet that has a face mask. An energy-protective liner is placed under the top portion of the face mask, between the face mask and the helmet. It will therefore be realized that the prior art provides no solution to the problem of pieces of turf or the like which may clog the space between the top rod of the face mask and the helmet.

It is therefore an object of the present invention to solve the problem resulting from the introduction of pieces of turf or the like between the top rod of the face mask and the football helmet.

It is another object of the present invention to provide a turf guard for a football helmet which is efficient, easy to manufacture and install, and is economical.

It is another object of the invention to provide a turf guard which prevents players from grabbing the top of the face mask when trying to tackle or, in the case of linemen, grabbing the top of a player's mask in order to get an advantage, and is very useful in preventing face mask penalties.

SUMMARY OF THE INVENTION

According to the invention, in a football helmet having a face mask fixed thereto, the face mask comprising a plurality of spaced apart connected rods, including a top rod, the rods being bent to shaped so that the face mask generally follows the contour of a player's face and is spaced therefrom, the face mask being attached to the helmet, the top rod being in close vicinity of the outer face of the helmet along the edge thereof adjacent to the forehead of a football player, there is provided a guard means and means for affixing the guard means all along the top rod, the guard means extending away to the outer face of the helmet above the top rod in sealing engagement therewith so as to close any void that may be present between the helmet and the top rod along the above edge.

Other details of the invention will appear as the description will follow.

BRIEF DESCRIPTION OF THE DRAWINGS

The invention will now be illustrated by means of a preferred embodiment which is given only as an illustration and without limitation and in which.

DESCRIPTION OF PREFERRED EMBODIMENT

With reference to the drawings it will be seen that a turf guard 1 according to the invention is shown in position on a football helmet 3, the latter being provided with a standard face mask 5 which is fixed in a known manner to the football helmet 3, such as by screwing at 7. For more clarity, the football helmet 3 and the face mask 5 have been illustrated in dotted lines.

Figure 3:
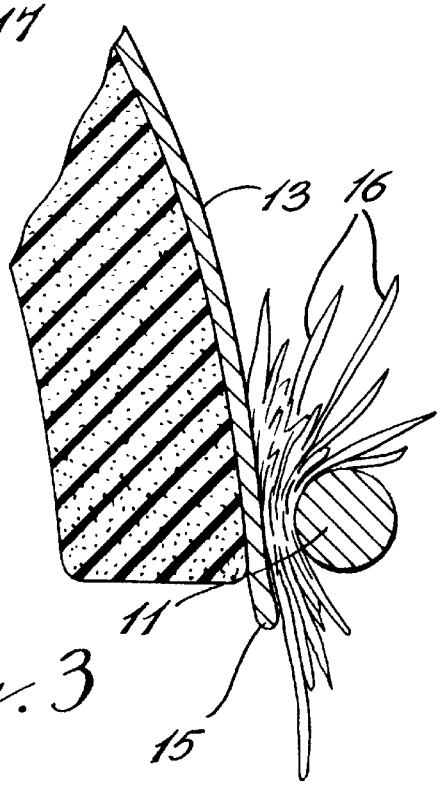
FIG. 3 is a cross-section view taken through a football helmet and the top rod of a corresponding face mask attached thereto and showing a piece of turf stuck therebetween.

As shown, the face mask will be seen to consist of a plurality of spaced apart connected rods 9, including top rod 11. Conventionally, the rods are bent to shape so that the face mask 5 generally follows the contour of a player's face (not shown) and is reasonably spaced therefrom. Also in standard fashion, top rod 11 is in close vicinity to the outer face 13 of football helmet 3, particularly along the lower edge 15 thereof adjacent the forehead (not shown) of a football player. From the illustrated football helmet and mask, it will easily be realized that foreign material, such as particularly turf 16, can easily become lodged in the void between top rod 11 and outer face 9 of the helmet (see FIG. 3). Even when this void becomes negligible, it is impossible to prevent the introduction of foreign matter therein especially because sometimes contact between the helmet and the ground is quite severe.

In order to prevent such lodging of turf, the helmet face mask combination includes turf guard 1, which will now be described in detail.

Figure 1:
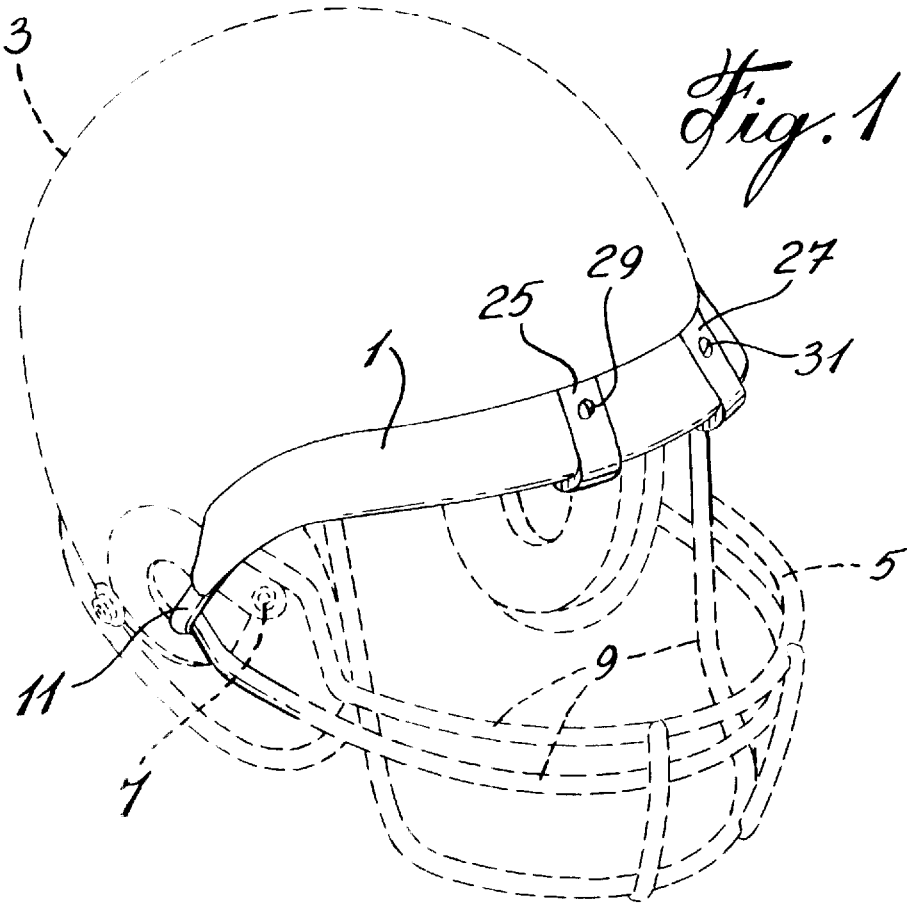
FIG. 1 is a perspective view of a turf guard according to the invention fixed to a football helmet provided with a face mask.
Figure 2:
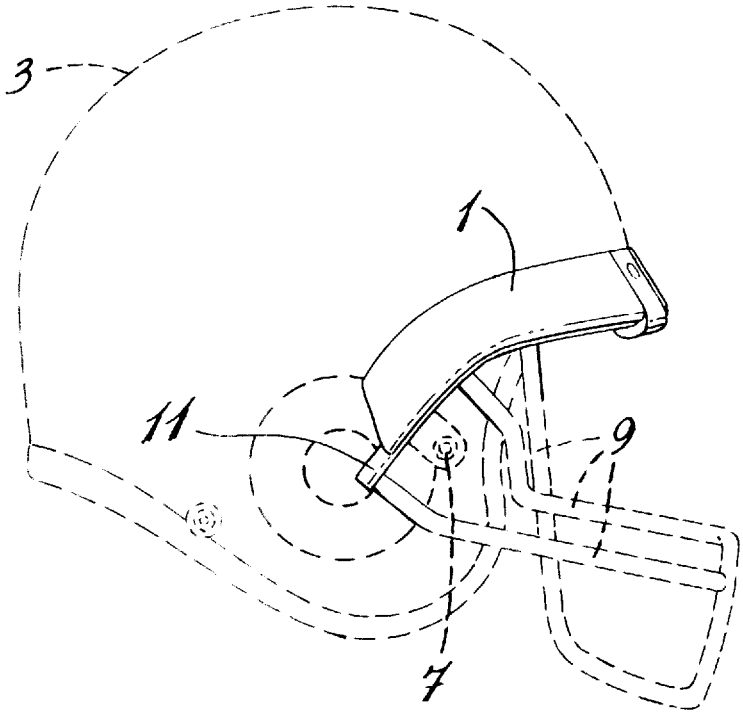
FIG. 2 is a side view of the same turf guard.
Figure 4:
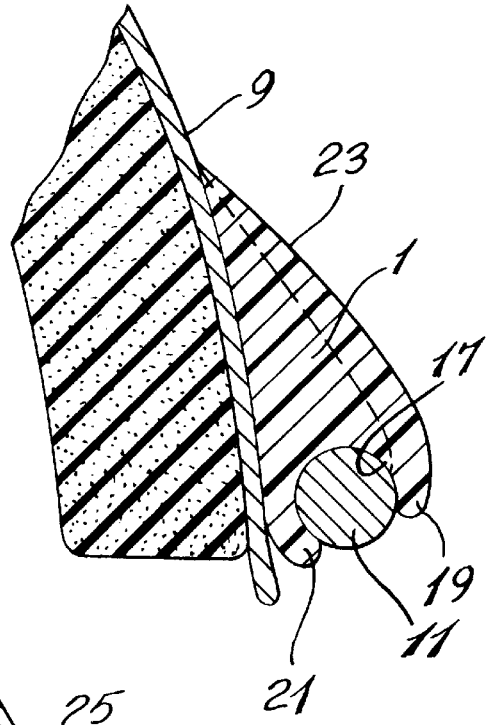
FIG. 4 is a transverse cross-section view of the top guard fixed to a football helmet and mounted over the top rod of a face mask.

As shown, turf guard 1 is a unitary member which is preferably produced by molding and is shaped to adapt exactly to the shape of top rod 11. The turf guard therefore runs approximately the exact length of the top rod, although, as will be noted, it may be fabricated just a bit shorter that top rod 11, for ease of handling and also because it is not needed in the range outside the vision of the football player (see FIGS. 1 and 2).

As shown, particularly in FIGS. 4 to 7, turf guard 1 appears, in cross-section, generally as an elongated triangular shape. In the lower portion, there is provided a jaw 17 which is shaped to engage over top rod 11. More particularly, jaw 17 is formed with a front lip 19, the lower end curving partly around the lower portion of top rod 11. Jaw 17 also includes a rear lip 21 which descends along the rear portion of top rod 11 and which downwardly extends short of the end of front lip 19 as shown. Above the two lips 19, 21, turf guard 11 consists of a tapering portion 23 which extends upwardly, say about 1–2 inches, until merging with outer face 9 of the football helmet. Since the turf guard according to the invention is made of a rigid but resilient material, such as a plastic of the type well known to those skilled in the art, the turf guard is mounted by snapping jaw 17 over the entire length of top rod 11, that it intends to cover. This may provide sufficient adhesion between turf guard 1 and outer face 9, however, to make sure that the turf guard will stay in play once it is mounted, there is provided a pair of attachment arms 25, 27 which are shaped to match the outer contour of the turf guard 1 and which are screwed at 29, 31 into the helmet.

Figure 5:
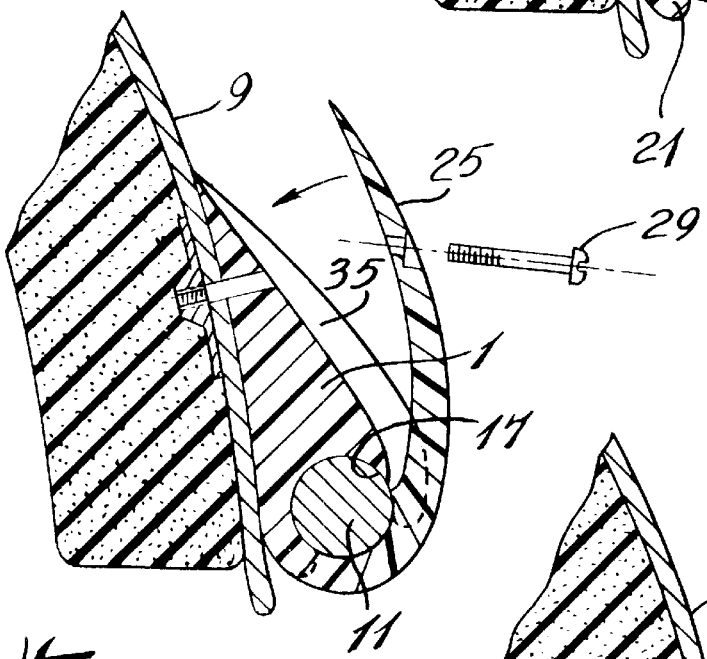
FIG. 5 is a cross-section view taken through the football helmet and its corresponding turf guard and also showing an attachment arm in an opened position.
Figure 6:
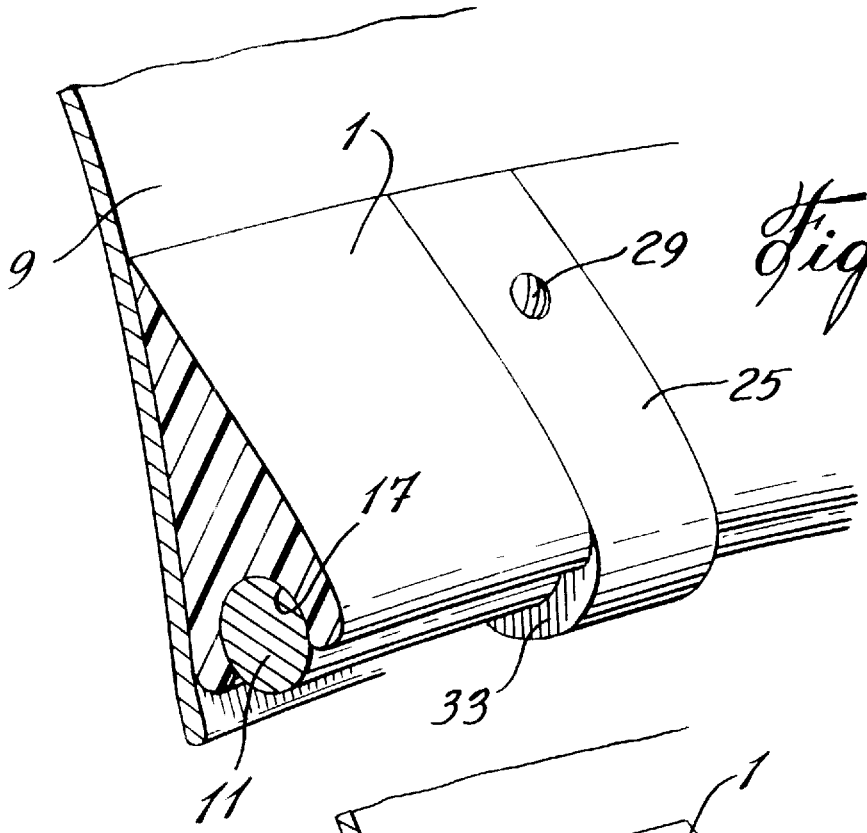
FIG. 6 is a perspective view showing the turf guard mounted on a football helmet face mask combination with the attachment arm in a closed position.
Figure 7:
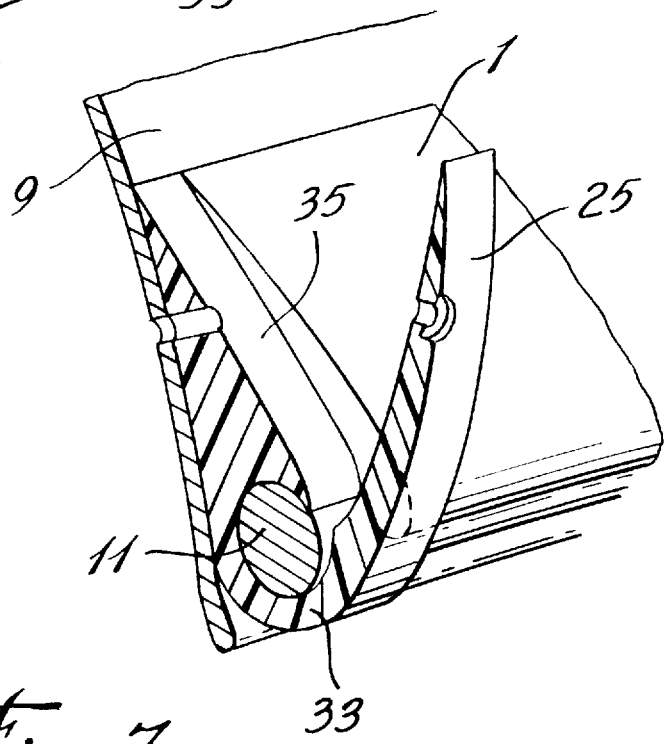
FIG. 7 is another perspective view showing the attachment arm in opened the position.

The attachment arms 25,27 will be more particularly described with reference to FIGS. 5, 6 and 7 particularly with respect to attachment arm 25. It will be seen that attachment arm 25 is unitary with guard 1 and is connected thereto by means of a wrap around hinge 33 also unitary with guard 1, as shown. Attachment arm 25 constitutes an extension of hinge 33 and its thickness regularly decreases to nothing where it meets the top end of guard 1. To lodge the attachment arm there is formed a longitudinal cavity 35 in the guard 1 which is shaped exactly to receive attachment arm 25. Arm 27 is similar to arm 25. For mounting the guard, the latter is snapped over top rod 11 by means of jaw 17 and lips 19 and 21, and the attachment arm and hinge are wrapped around to rod 11, after which the attachment arms are screwed into the helmet by means of screws 29,31.

So constructed, it will easily be realized that, for all practical purposes it is just about impossible that even after a solid contact between the face mask and the ground, turf may become lodged between the top rod of the face mask and the outer face of the helmet.

Manufacture of the turf guard according to the invention is easy to accomplish by any one skilled in the art, such as by molding and the like.

Of course, modifications are possible without departing from the scope and spirit of the invention, all as defined in the appended claims.

I claim:

1. In a football helmet having a face mask fixed thereto, said face mask comprising a plurality of spaced apart connected rods, including a top rod, said rods bent to shape so that the face mask generally follows the contour of a player's face and is spaced therefrom, said face mask attached to said helmet, said top rod being in close vicinity of the outer face of the helmet along an edge thereof adjacent a forehead of a football player, the improvement comprising guard means which comprise a unitary member which is shaped to adapt to the shape of said top rod, clamping means adapted to snappingly engage said unitary member over said top rod, said unitary member being formed with a lower jaw engaged over said top rod, said lower jaw including a front lip which covers a major part of the front periphery of said top rod and a rear lip covering a major portion of the rear periphery of said top rod, so that when enclosed over said top rod, the forward ends of said front and rear lips come in close proximity to one another, said unitary member also being formed with a solid tapering upper portion which merges with the outer face of said helmet at the uppermost end thereof.

2. A football helmet according to claim 1, wherein attachment arms are provided to further fix said unitary member to said helmet.

3. A football helmet according to claim 2, wherein said attachment arms are unitary with said guard means, said attachment arms are connected to said guard means through wrap around hinges, longitudinal cavities are formed in said guard means to lodge said attachment arms, and said attachment arms are screwed through said unitary member into said helmet.

* * * * *